US010306973B2

(12) United States Patent
Evans et al.

(10) Patent No.: US 10,306,973 B2
(45) Date of Patent: Jun. 4, 2019

(54) EXPANDABLE CARRY POUCH WITH VARIABLE COMPRESSION

(71) Applicants: Scott Evans, Jacksonville, NC (US); Nicholas Tomczak, Jacksonville, NC (US)

(72) Inventors: Scott Evans, Jacksonville, NC (US); Nicholas Tomczak, Jacksonville, NC (US)

(73) Assignee: Edge-Works Manufacturing Company, Burgaw, NC (US)

( * ) Notice: Subject to any disclaimer, the term of this patent is extended or adjusted under 35 U.S.C. 154(b) by 344 days.

(21) Appl. No.: 15/291,437

(22) Filed: Oct. 12, 2016

(65) Prior Publication Data

US 2017/0099934 A1 Apr. 13, 2017

Related U.S. Application Data

(60) Provisional application No. 62/240,337, filed on Oct. 12, 2015.

(51) Int. Cl.

| | |
|---|---|
| ***A45F 5/00*** | (2006.01) |
| ***A45F 5/02*** | (2006.01) |
| ***F42B 39/02*** | (2006.01) |

(52) U.S. Cl.

CPC ..... *A45F 5/02* (2013.01); *A45F 5/021* (2013.01); *F42B 39/02* (2013.01); *A45F 5/00* (2013.01); *A45F 2005/008* (2013.01); *A45F 2200/0591* (2013.01)

(58) Field of Classification Search

CPC .... A45F 5/02; A45F 5/021; A45F 5/00; A45F 2005/008; A45F 2200/0591; F42B 39/02

USPC ..... 224/191

See application file for complete search history.

(56) References Cited

U.S. PATENT DOCUMENTS

| | | | | |
|---|---|---|---|---|
| 6,154,997 | A * | 12/2000 | Aluotto | F41C 33/02 224/239 |
| 6,202,908 | B1 * | 3/2001 | Groover | F42B 39/02 224/236 |
| 7,025,238 | B2 * | 4/2006 | Hughes | A45F 5/00 206/3 |
| 8,011,544 | B1 * | 9/2011 | Howell | A45F 5/02 224/196 |
| 8,485,405 | B2 * | 7/2013 | Crye | F41A 9/65 224/251 |
| 8,887,977 | B2 * | 11/2014 | Ralph | F42B 39/02 224/245 |

* cited by examiner

*Primary Examiner* — Peter N Helvey

(74) *Attorney, Agent, or Firm* — Christina Chamberlain; Stephen M. Kepper; Intellectual Property Consulting, L.L.C.

(57) ABSTRACT

An expandable, variable compression pouch with an exoskeleton construction, which is a hybrid construction that combines a soft, flexible shell with semi-flexible molded outer components on the back, sides, bottom and front of the flexible shell. These molded components form an exoskeleton that provides structural reinforcement where needed without limiting the essential qualities of expansion or contraction or form fit that is essential to achieve the unique features and superior function of the pouch of the present invention.

19 Claims, 19 Drawing Sheets

EXPANDABLE CARRY POUCH WITH VARIABLE COMPRESSION

RELATED APPLICATIONS

This application claims priority to U.S. Provisional Application No. 62/240,337 filed Oct. 12, 2015. The entire contents of the above application are hereby incorporated by reference as though fully set forth herein.

FIELD

The present invention relates to the field of devices designed for the holding of tactical gear. More specifically, the present invention relates to devices designed to retain and secure tactical gear to the person, clothing or gear of a user.

BACKGROUND

In a tactical environment or situation or training or sporting activity the need of the operator, soldier, law enforcement officer, civilian sportsman or other user to carry various gear on one's person, in support of the mission or activity is always present. As such users are continually searching for improved methods and items to carry their gear. Such improvements often include features that increase the amount of gear being carried through a more efficient use of space, modularity in using and arranging such gear specific to a user's needs and improved accessibility to said gear while maintaining a reasonable (and sometimes adjustable) level of security in carrying such items. These items include but are not limited to: rifle magazines, pistol magazines, ammunition, radios, flashlights, batons, handcuffs, flash bangs, hand grenades, batteries, scopes or other aiming devises, or any other items as may be considered useful for their task. Additionally, users seek durability in such carry pouches as their need is essential and their operating locations are often remote.

Devices for the retention and securing of tactical gear are known in the prior art and generally have a pouch having an upward-oriented opening a flap mechanism that obstructs the upward-oriented opening when the flap mechanism is engaged and closed, means for fastening the flap mechanism in a closed position and means of attachment whereby the pouch is either an integrated feature of the clothing of a user or may be otherwise attached to the clothing or accessories worn by a user. These devices are limited in that they slow down access to stored gear. While the flap keeps the gear from falling out of the pouch, it keeps the user from quickly and efficiently removing the gear from the pouch. For example, when the pouch is used to store an ammunition magazine, the flap must first be unfastened and restrained to access the magazine contained within the pouch. This causes a delay when trying to negotiate the flap mechanism, which can be the difference between life and death for a user in a combat situation.

Also known in the prior art are devices for the retention and securing of gear wherein the pouch has an upward oriented opening but no flap mechanism. In these instances, the pouch dimensions must match the dimensions of the gear to provide a tight fit for the gear by virtue of the force of friction between the interior of the pouch and the gear it contains. By tailoring the pouch to ensure a tight fit for a specific gear, the pouch lacks the ability to securely retain and store gear of varying shapes and sizes. Each pouch tends to be designed for a particular size and shape of gear and, therefore, a single user may need to acquire several of these devices in varying sizes and designs to effectively secure, store and retain a variety of gear, such as various shapes and sizes of magazine ammunition.

Other pouch systems designed to carry ammunition magazines, or other similar size items are sometimes constructed as a simple soft fabric, sewn bag or pouch. Since these devices are loose and offer no retention on the items carried, retention straps or flaps as described above are required to retain the carried items securely in the pouch. Additionally, insertion of items into the pouch is often difficult as snagging against the floppy edges of the pouch opening interferes with the smooth reception of the items to be carried.

There is also simple soft fabric, sewn pouches with some elastic quality, which are generally sewn bags that compress against the item being carried and offer some retentive qualities. However, once the item is removed from the pouch the pouch collapses on itself and insertion of another item or reinsertion of the carry item is difficult.

Another known device is a molded, polymer loose fitting pouch or box, which offer space to carry an item, or a small range of similarly sized items, but with no retentive qualities. As such they also require retention straps or flaps to securely retain the carry items as described above.

There are also molded, form fitted polymer precision fitting pouches that are shaped to fit specific items only, with an extremely limited range of what can be carried. Some such pouches allow for a range of tension adjustment to aid in retention and security of the item carried, however, such is limited to only those specific items the pouch is formed to fit.

As such, there is a need for a device to hold a wide range of sized and shaped items that can be inserted into the device with a high level of retention and security for each without straps or flaps. There is also a need for a device that that both securely holds gear of various shapes and sizes but does not hinder the user in accessing the gear by having to open and restrain a flap that covers the opening for insertion of gear.

While there are variable types of compression pouches known in the prior art, the present invention has various advantages and improvements that are not known or described in the prior art.

BRIEF SUMMARY OF THE INVENTION

The present invention seeks to meet these needs by providing a novel expandable variable compression carry pouch with an inner surface that form fits to, and retains securely, the object being carried. Such items include, but are not limited to, ammunition magazines for handguns, for rifles or other similar items or any and all other items of similar size or shaped items as may be desired to be carried within the pouch. The pouch has variable compression with an exoskeleton construction, which is a hybrid construction that combines a soft, flexible shell with semi-flexible molded outer components on the back, sides, bottom and front of the flexible shell. These molded components form an exoskeleton that provides structural reinforcement where needed without limiting the essential qualities of expansion or contraction or form fit that is essential to achieve the unique features and superior function of the pouch of the present invention.

Flared surfaces on all four sides of the pouch opening allowing smooth, blind insertion of the mag into the pouch. Molded channels and recesses on the molded outer components control and protect the binding cord and eliminate snags and wear. The front plate is engineered to direct pressure down through the flexible shell forcing its inner friction surface to make positive contact along the length of the magazine. With minimal adjustment to the cord, the holding power of the pouch can be multiplied through the designed leverage in the system. Additionally, the cross bars of the rifle mag pouches front plate allow pistol mag pouches to be stacked at variable levels on the rifle pouch. The back plate is molded to include threaded inserts (such as brass inserts) allowing the rapid change of mounting accessories.

In the preferred embodiment, superior materials are used to construct the pouch, including but not limited to, super-tough nylon to construct the inner shell. The molded outer components are preferably constructed from a thermoplastic elastomer such as Santoprene™. In addition to extreme strength and durability, these materials absorb no moisture and gain no weight when exposed to water.

The hybrid construction method of stitching the molded outer components to the flexible shell eliminates unnecessary bulk and weight. The present invention preferably weighs less than 4 oz., which makes the design among the lightest available yet give no compromise in durability, function, or features.

The molded components use formed channels and corresponding recesses to guide and protect the binding device used to bind or lace together the molded components. The formed channels enhance the weave or lacing patterns available as well as allow the tension of the binding cord to be fixed or variable. The molded components can be generic or specific in shape relative to what is to be carried. Further, the pouch has a plurality of molded mounting points to allow the pouch to be completely modular with itself and an entire family of other pouches and mounting components. Finally, the present invention is smaller with a more compact design and is more efficient in its use. Overall method of construction, materials and process used, protective features incorporated to enhance durability of the pouch and form fitting components all add to the above desired improvements in a unique combination.

DETAILED DESCRIPTION

Figure 1:
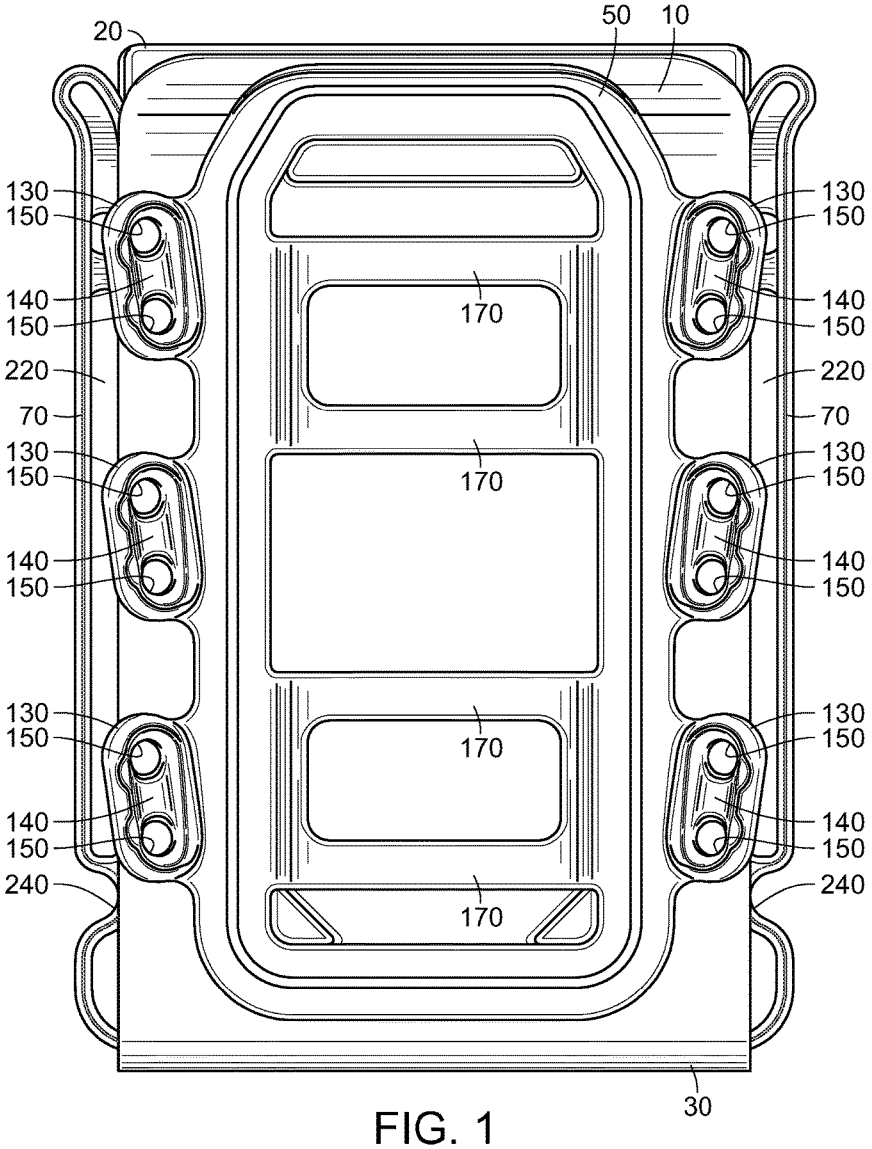
FIG. 1 Front view of one embodiment of the variable compression pouch of the present invention.
Figure 2:
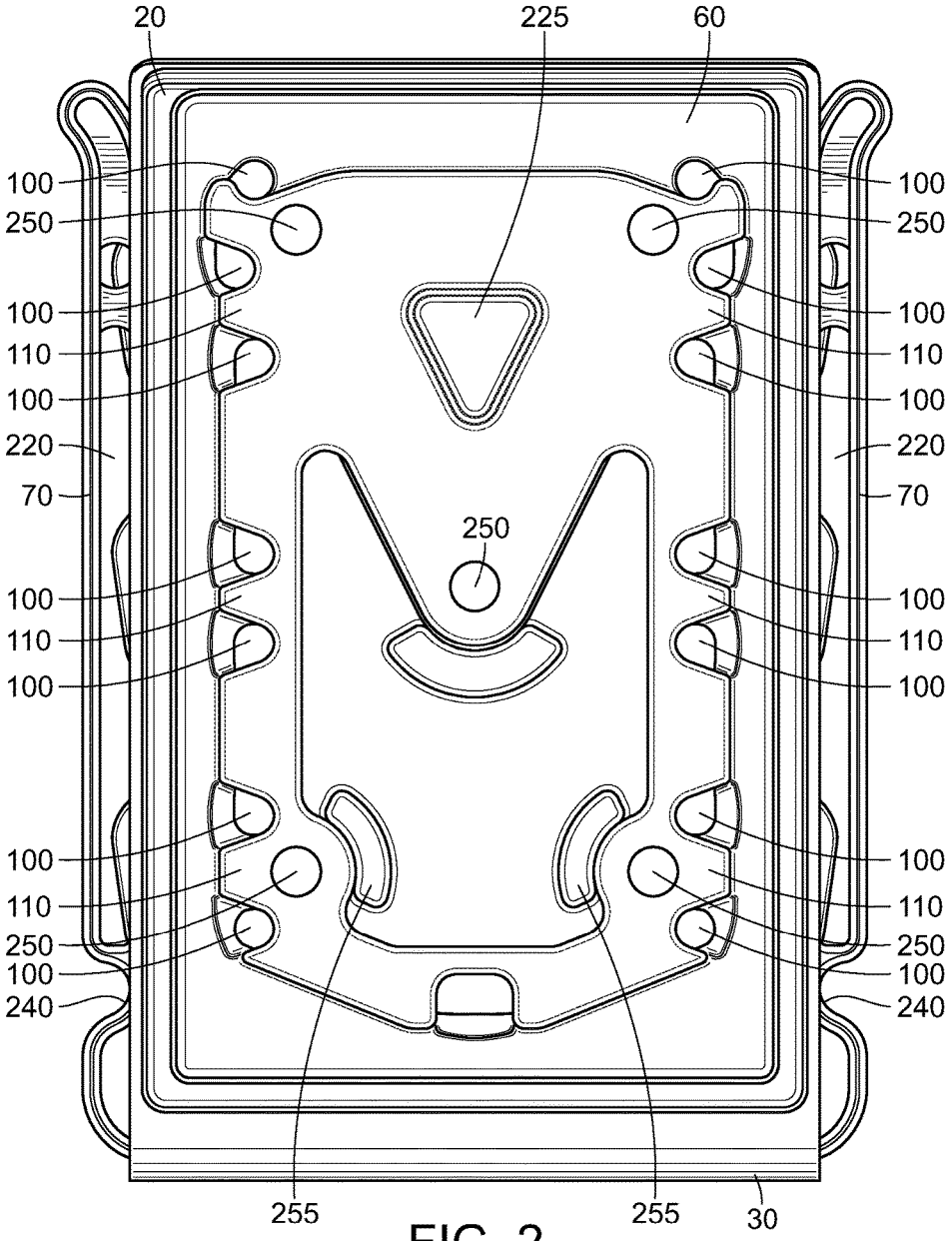
FIG. 2 Back view of the variable compression pouch of FIG. 1.
Figure 3:
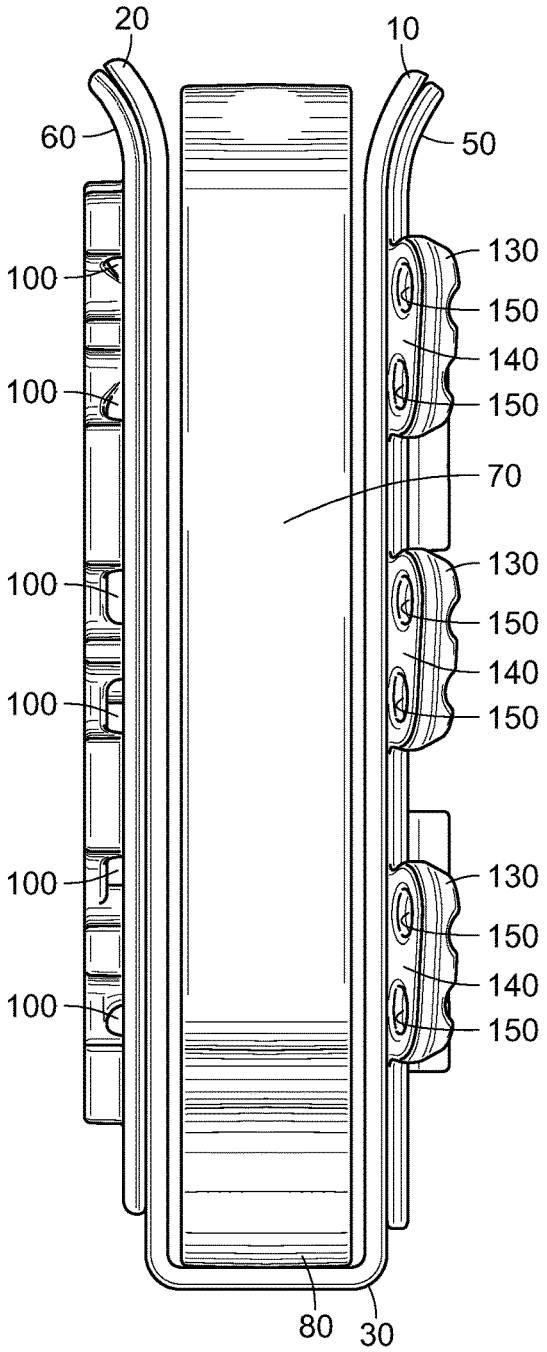
FIG. 3 Side view of the variable compression pouch of FIG. 1.
Figure 4:
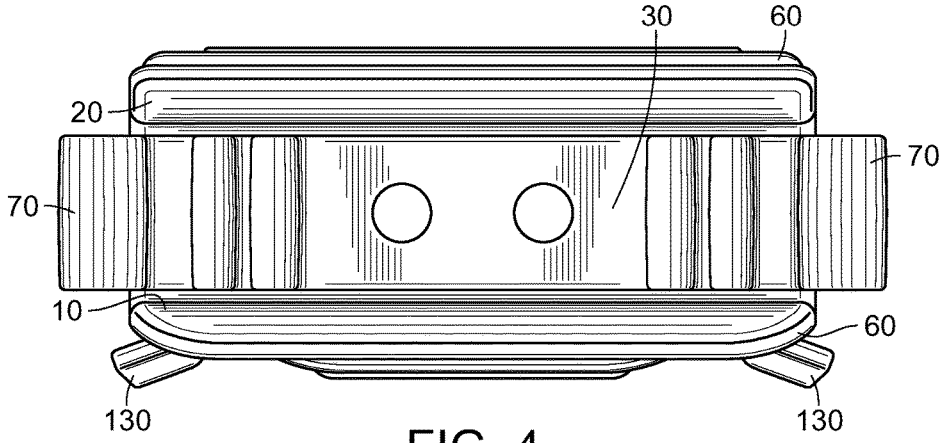
FIG. 4 Top view of the variable compression pouch of FIG. 1.
Figure 5:
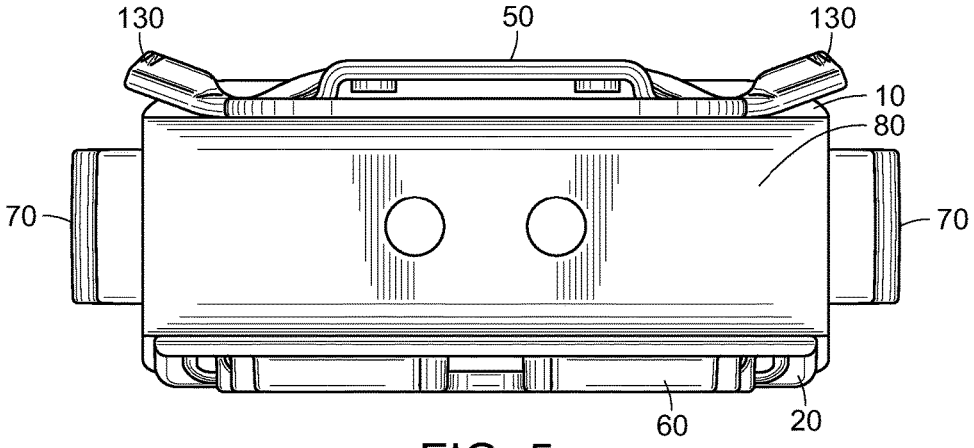
FIG. 5 Bottom view of the variable compression pouch of FIG. 1.

Turning to FIG. 1, a flexible component that can be made of but not limited to, sewn nylon fabric, or leather, or molded polymer or other materials or combinations thereof, fits inside an exoskeleton outer structure of molded components. The flexible shell has at least one pair of opposing walls, such as a front 10 and back 20 wall, and a bottom wall 30. The top of the flexible shell remains open. The inside surface of the flexible shell is composed of or lined with a material that creates friction against objects placed within the flexible shell, such as a thin sheet of high density polyethylene. This flexible shell flexes so as to conform to objects placed within the assembled pouch.

Turning to FIGS. 1-8, one embodiment of the pouch of the present invention is shown with a flexible shell with opposing front 10 and back 20 walls, a bottom wall 30, an open top end 40 where the flexible shell has an interior surface and an exterior surface. A plurality of semi-flexible outer components form an exoskeleton with opposing front 50 and back 60 walls, opposing side walls 70, a bottom wall 80 and an open top end 90 that defines an interior compartment. There may be a plurality of apertures 150 along the perimeter of the front wall 50 and apertures 100 along the perimeter of the back wall 60. This exoskeleton structure of outer molded components supports the flexible shell.

Figure 18:
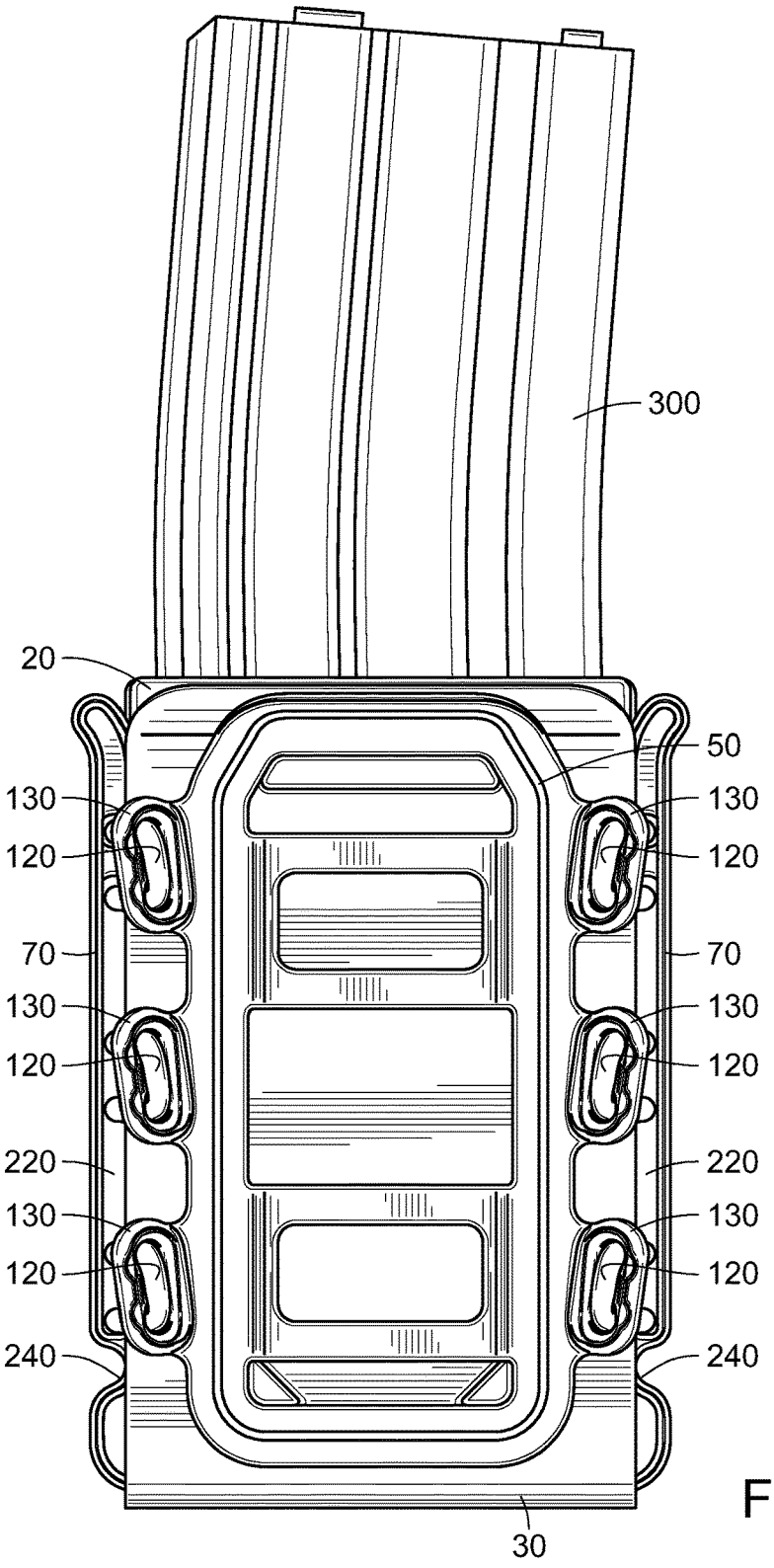
FIG. 18 front view of one embodiment of the variable compression pouch of the present invention with magazine carrier inserted into the pouch.
Figure 19:
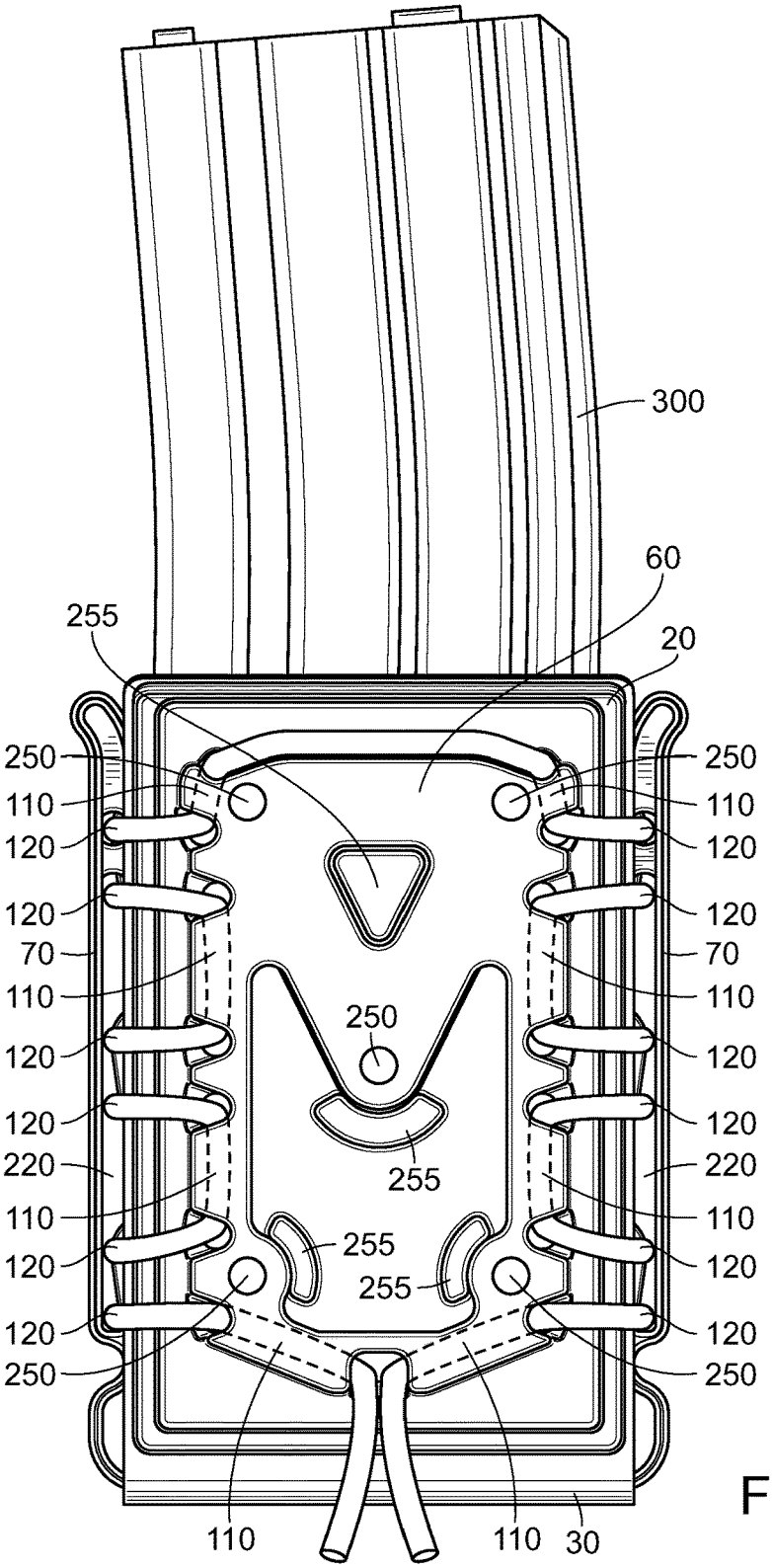
FIG. 19 back view of one embodiment of the variable compression pouch of the present invention with magazine carrier inserted into the pouch.
Figure 20:
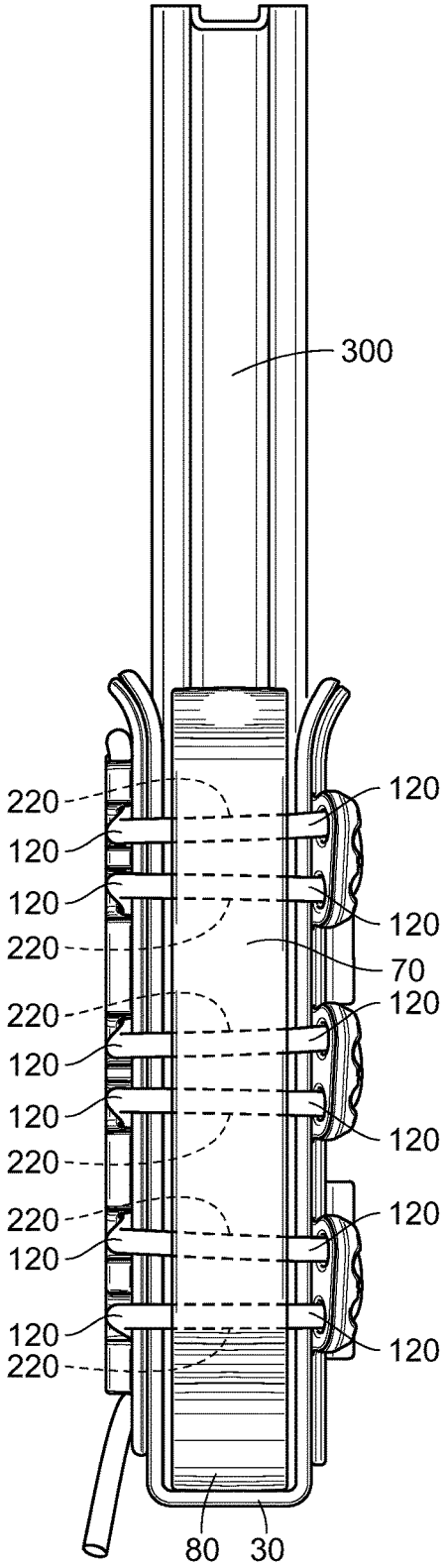
FIG. 20 side view of one embodiment of the variable compression pouch of the present invention with magazine carrier inserted into the pouch.
Figure 21:
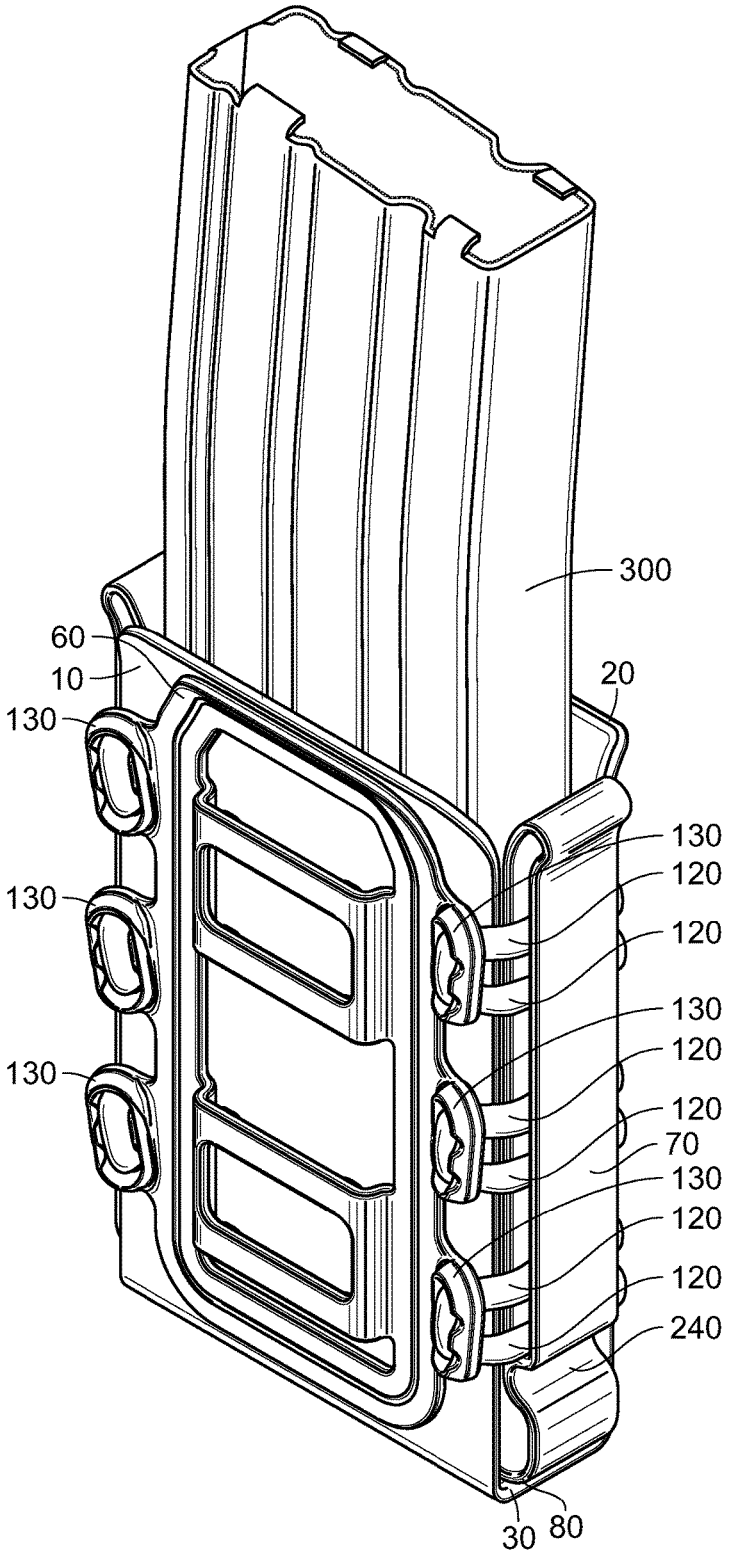
FIG. 21 perspective side view of one embodiment of the variable compression pouch of the present invention with magazine carrier inserted into the pouch.

As shown best in FIG. 19, the molded outer components may have channels 110 on the outer surface of the back wall 60. As shown in FIGS. 18-21, a binding cord 120 is laced through the apertures 100 of the molded outer components and the channels 110 and then tightened to compress the front 50 and back 60 walls against the flexible shell.

In one embodiment, a side channel support 120 fits inside the bottom wall 30 of the flexible shell and forms the opposing side walls 70 and bottom wall 80 of the exoskeleton structure. Attached to the flexible shell front wall 10 is the front wall 50 of the exoskeleton. The front wall 50 may be attached by various methods known in the prior art, such as sewing, gluing, riveting, screwing, or using a hook and loop fastener. Attached to the flexible shell back wall 20 is the back wall 60 of the exoskeleton. The back wall 60 may be attached by various methods known in the prior art, such as sewing, gluing riveting screwing, or using a hook and loop fastener. The front wall 50 is aligned so as to transfer pressure though the flexible shell lined with or composed out of a friction material forcing the friction material against any item carried within the pouch, such as the magazine carrier of FIGS. 18-21, enhancing the retentive qualities of the pouch. The back wall 60 is also aligned so as to transfer pressure though the flexible shell lined with or composed out of a friction material forcing the friction material against any item carried within the pouch, such as the magazine carrier of FIGS. 18-21, enhancing the retentive qualities of the pouch.

The front wall 50 of the exoskeleton affixed to the outside surface of the front wall 10 of the flexible shell and the back wall 60 of the exoskeleton is affixed to the outside surface of the back wall 20 of the flexible shell. As such, the flexible shell front wall 10 and back wall 20 is forced to conform to the contours of the exoskeleton front wall 50 and the flexible shell back wall 20 is forced to conform to the contours of the exoskeleton back wall 60. In one embodiment of the present invention, a flare or angle shape is created at the top end of the exoskeleton front 50 and back 60 walls, thereby forcing a flare shape of the front 10 and back 20 walls of the flexible shell at the open end of the flexible shell. This flare allows items to be easily inserted into the pouch.

Figure 6:
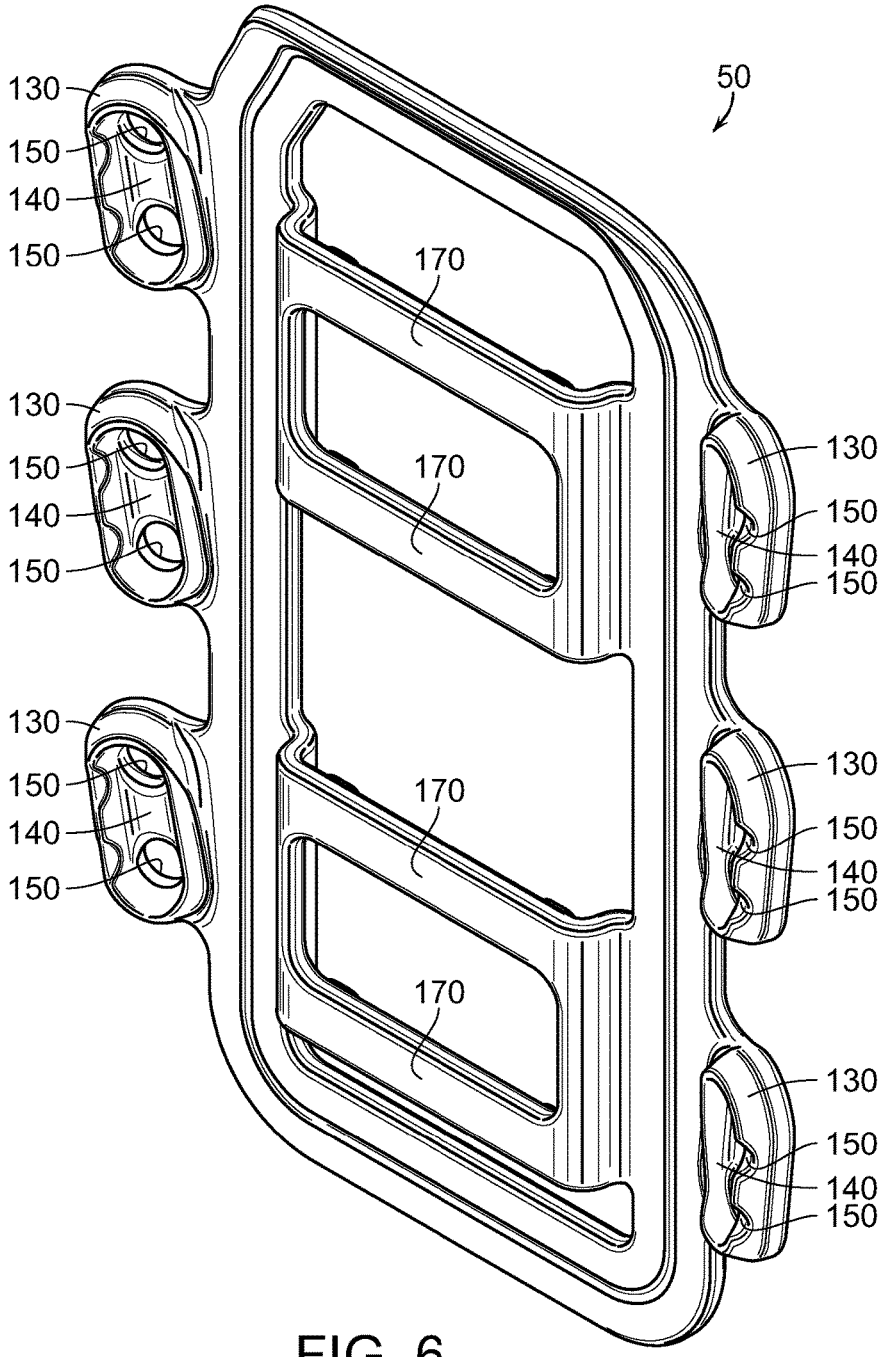
FIG. 6 perspective front view of front plate of the variable compression pouch of FIG. 1.

Turning to FIG. 6, the front wall 50 of the exoskeleton is shown in greater detail. The front wall of the exoskeleton has a plurality of tabs 130 along the perimeter that sweep slightly upward at an angle away from the flexible shell and a plurality of recessed channels 140 connecting a plurality of apertures 150 in the tabs 130.

As shown in FIGS. 18-21, this front wall 50 facilitates the attachment of a flexible binding cord 120 that secures front, back, and side components with an elastic effect that provides variable compression against any item carried within the pouch. Recessed channels 140 formed in the front wall 50 secure, guide, and protect the cord 120.

As shown in FIG. 6, a plurality of molded mounting bars 170 are arranged horizontally across the front of the front wall 50 that allow for the attachment of other components, other pouches, other magazine carriers, or other items that may be desired, to be attached to and carried on the front of the pouch of the present invention. For example, the cross bars of the front plate allow magazine pouches to be stacked at variable levels on a rifle pouch.

Figure 7:
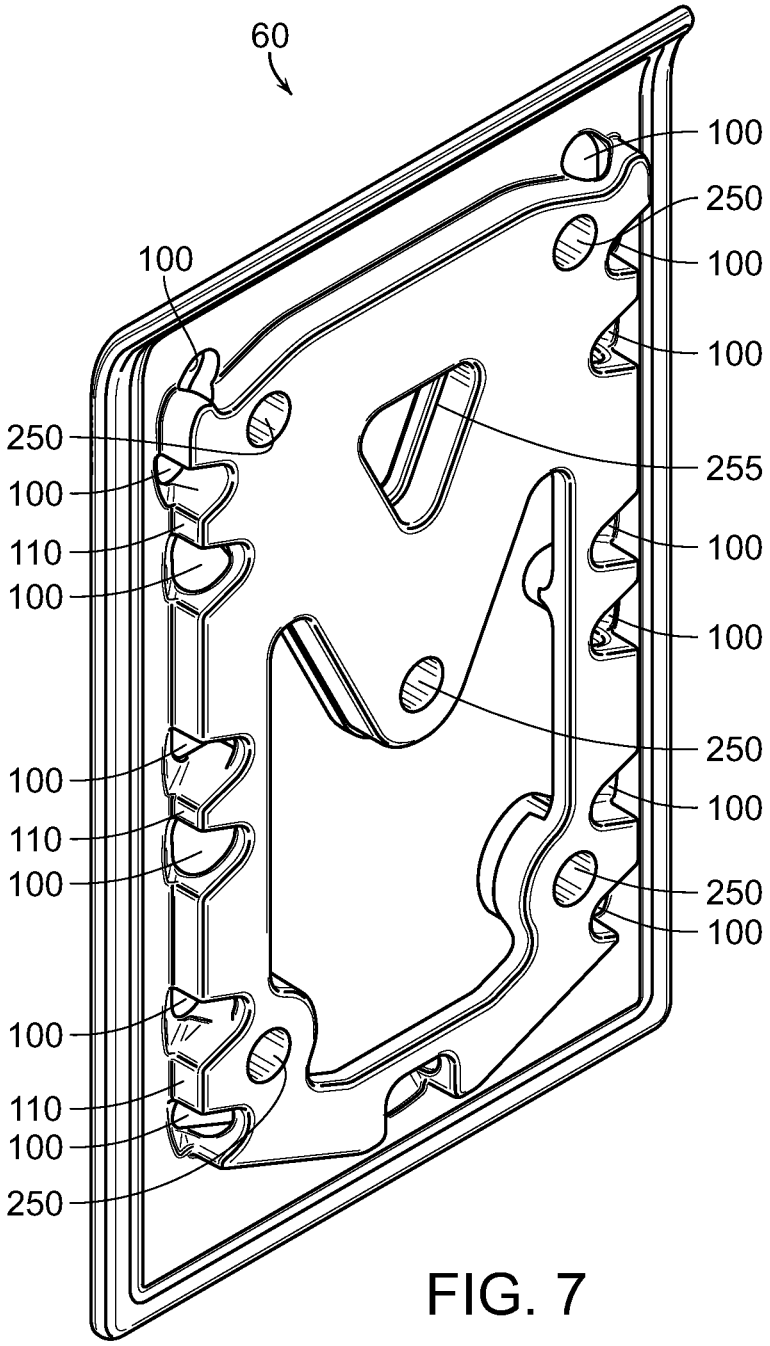
FIG. 7 perspective front view of back plate of the variable compression pouch of FIG. 1.

Shown in detail in FIG. 7, the mounting positions 255 of the molded back wall 60 facilitates the attachment of either a fixed mounting accessory or the interchangeable attachment of various modular mounting accessories. These mounting accessories include, but are not limited to, paddles, clips, loops and modular, lightweight, load bearing equipment (MOLLE) attachment devices. Such mounting accessories enable the pouch to be attached to, or carried on, but not limited to, a belt, to clothing in a vehicle, to furniture or on any MOLLE equipped gear including, but not limited to, belts, leg panels, chest rigs, shoulder harnesses, vests, ballistic armor plate carriers, other pouches and similar items.

In addition, the molded back wall 60 has a plurality of channels 110 that facilitates the attachment of the flexible, binding cord 120 that secures front, back, and side components with and elastic effect that provides variable compression against any item carried within the pouch. As shown in FIGS. 18-21, the channels 110 formed in the back wall 60 secure, guide the weave, and protect the cord 120.

Figure 8:
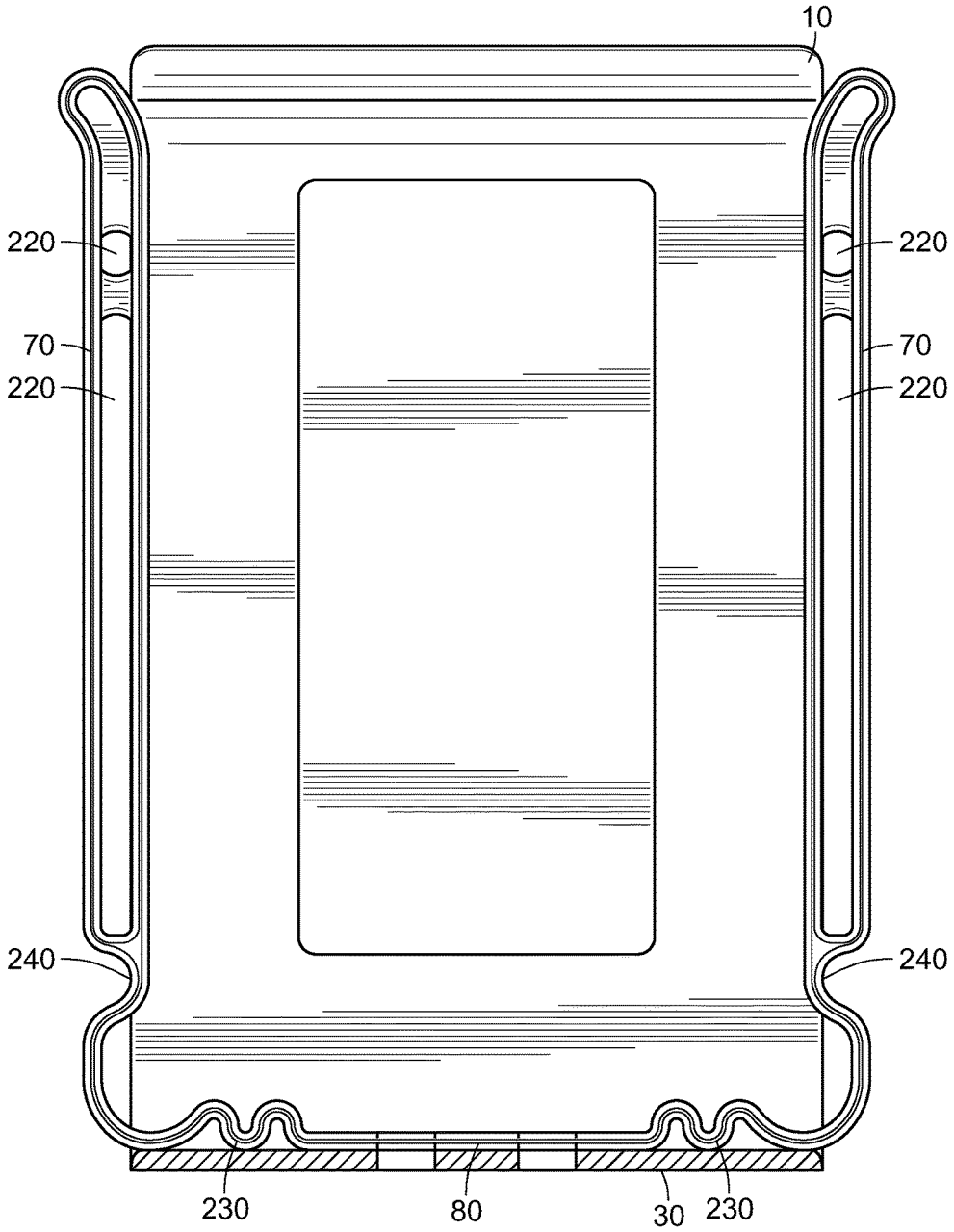
FIG. 8 front view of U-shaped portion of the variable compression pouch of FIG. 1.
Figure 9:
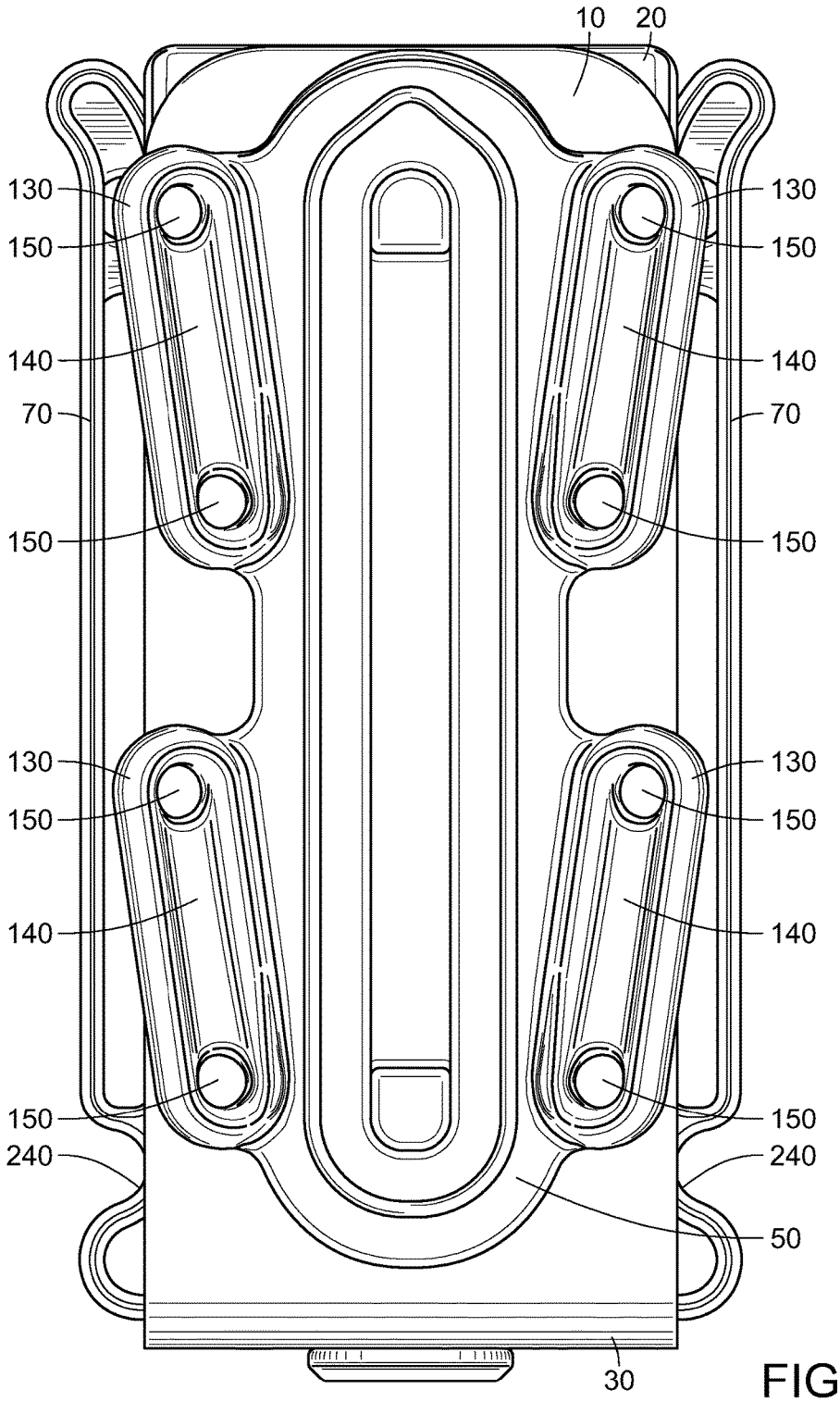
FIG. 9 front view of an alternative embodiment of the variable compression pouch of the present invention.
Figure 10:
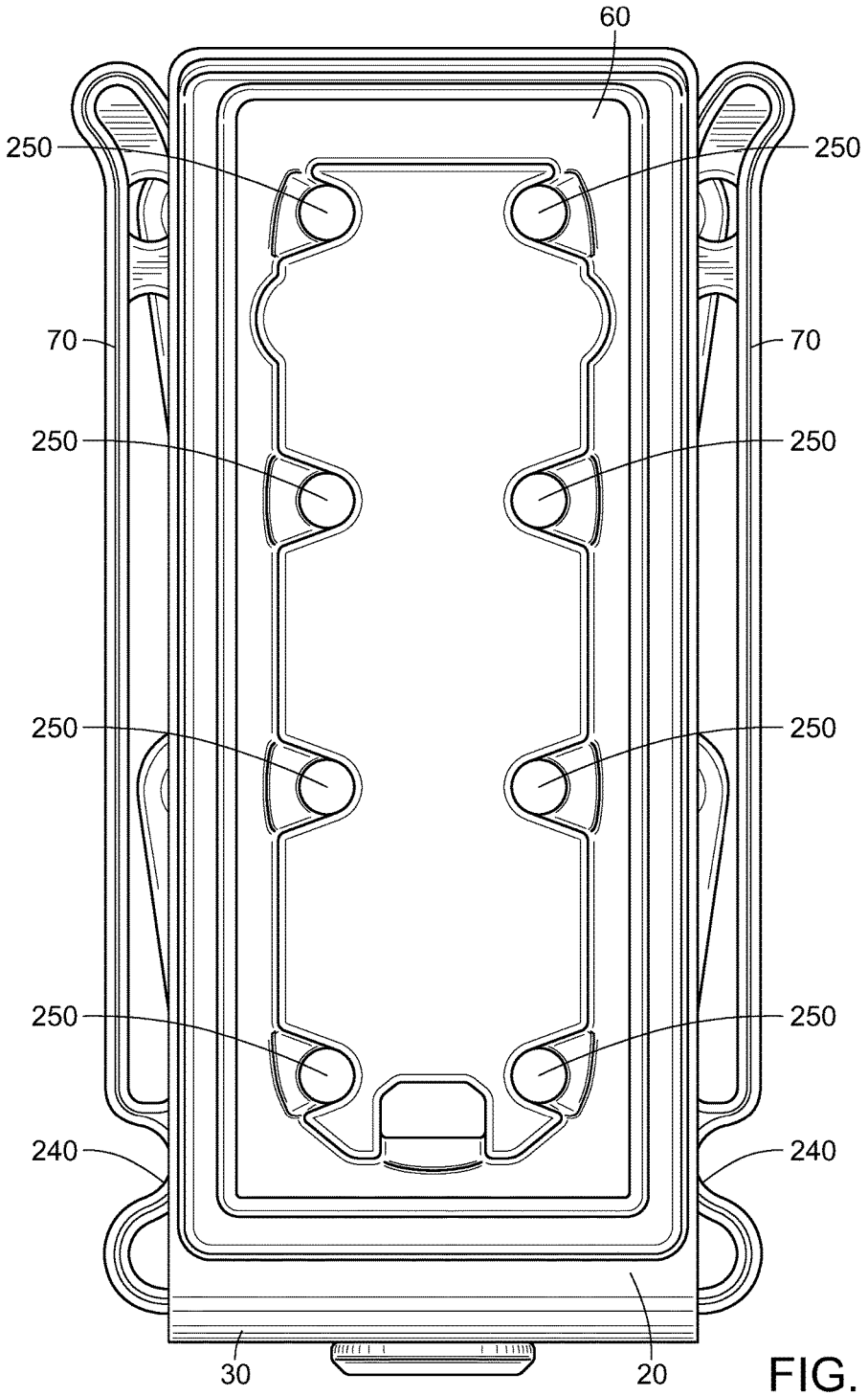
FIG. 10 back view of the variable compression pouch of FIG. 9.
Figure 11:
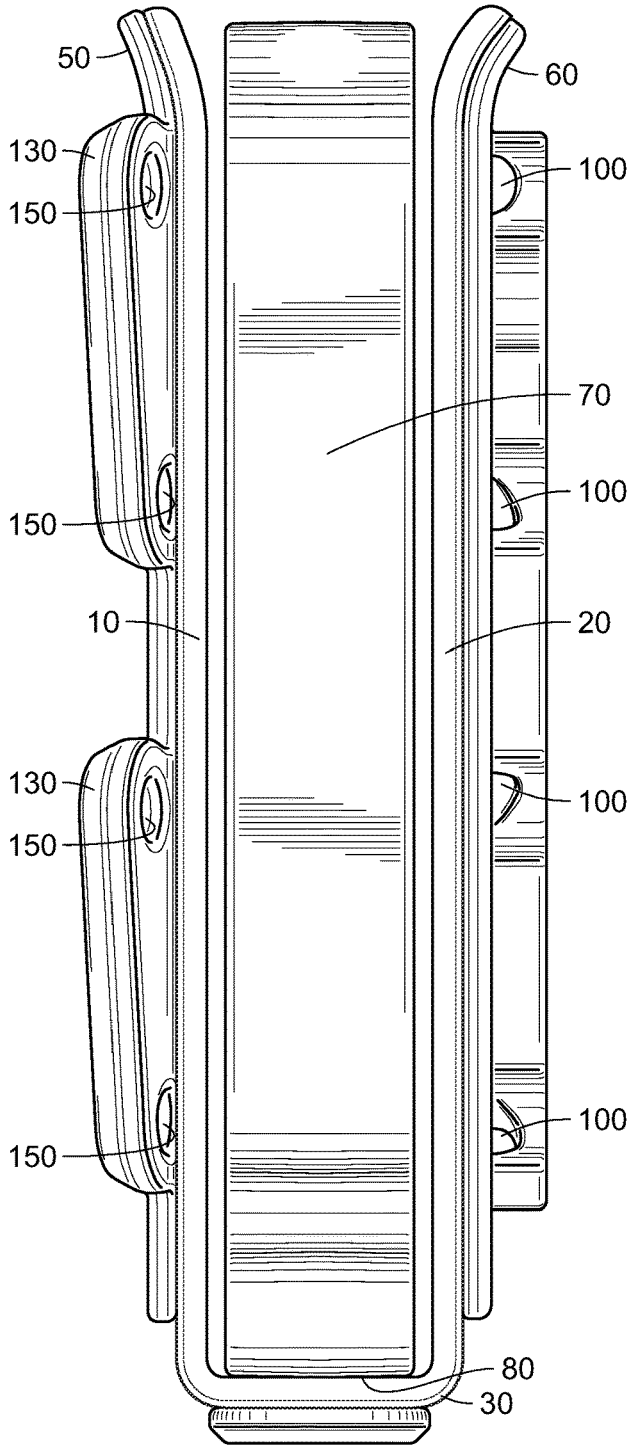
FIG. 11 side view of the variable compression pouch of FIG. 9.
Figure 12:
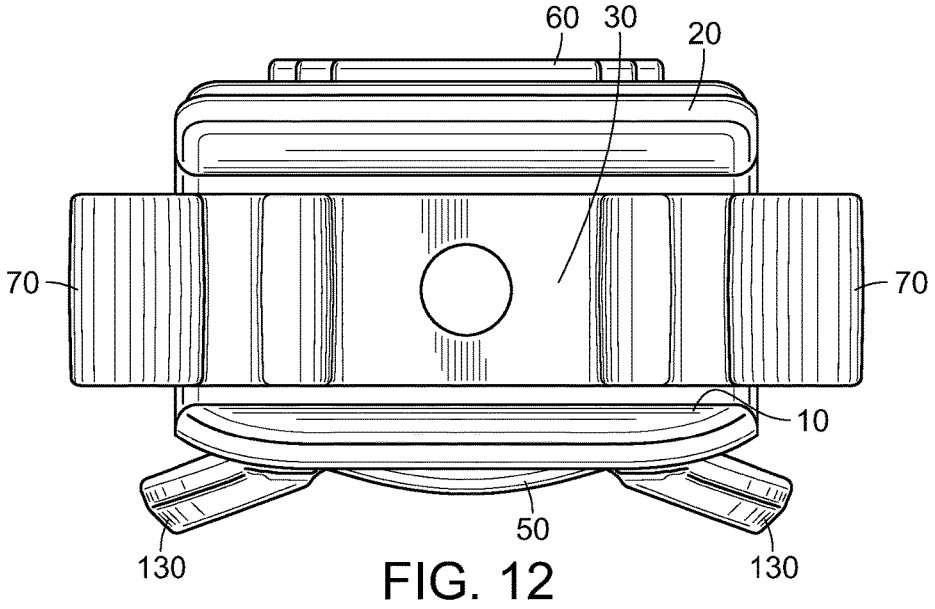
FIG. 12 bottom view of the variable compression pouch of FIG. 9.
Figure 13:
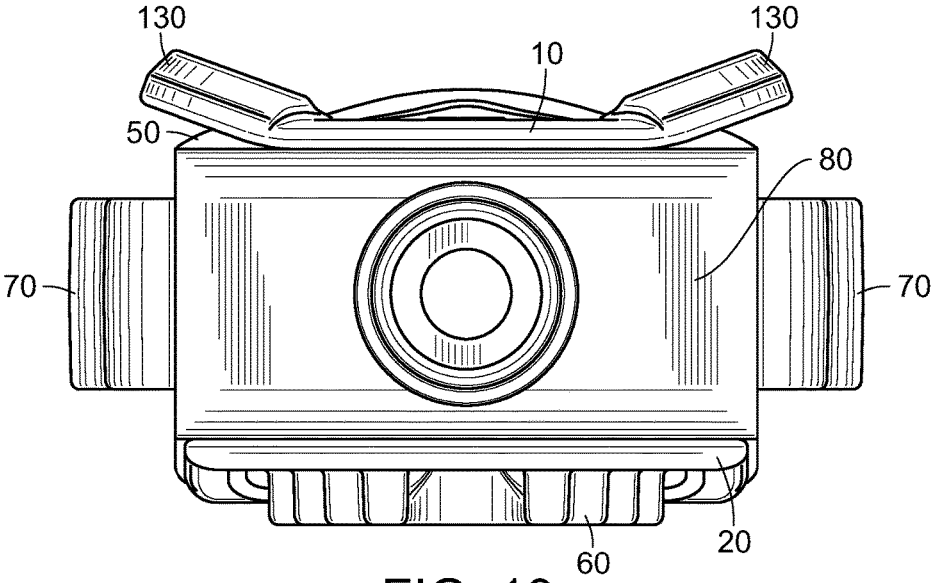
FIG. 13 top view of the variable compression pouch of FIG. 9.
Figure 14:
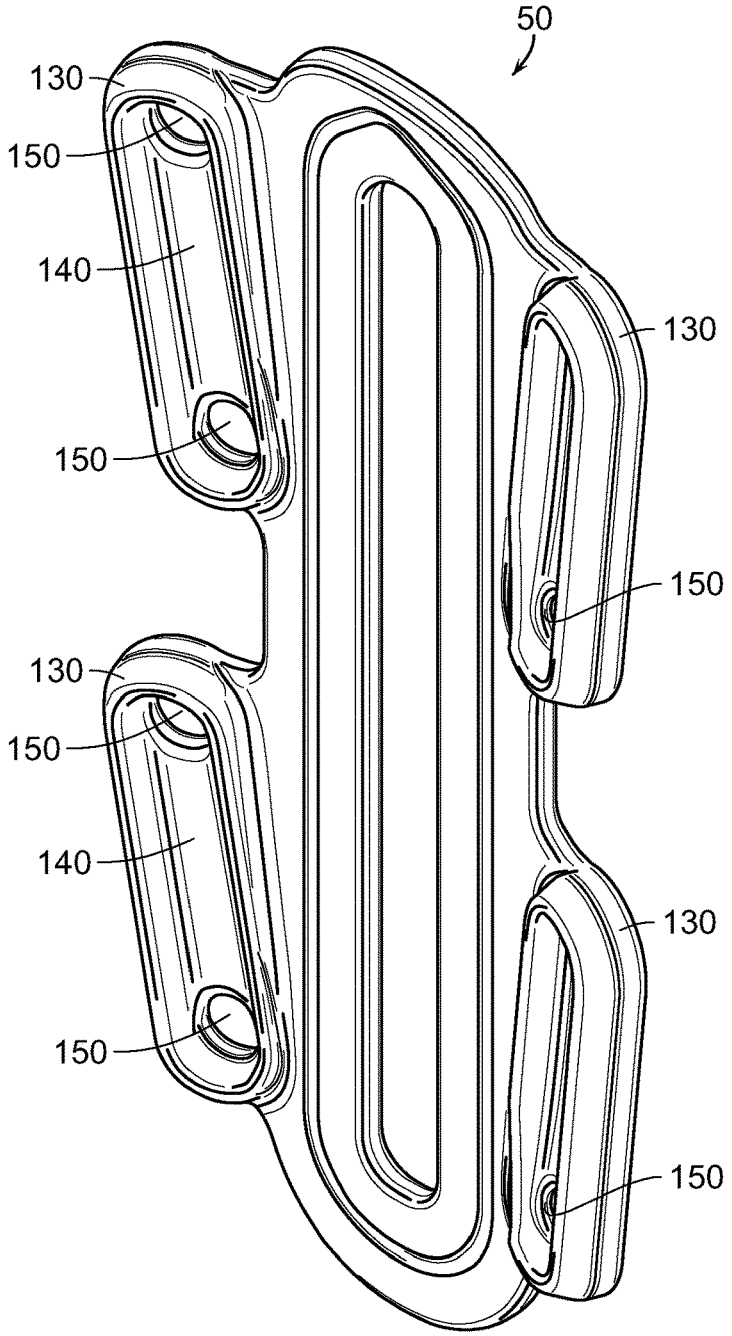
FIG. 14 perspective front view of front plate of the variable compression pouch of FIG. 9.

As shown in detail in FIG. 8, another embodiment of the present invention is a side channel support 190 that is a "U" shaped component that forms the left 200 and right 210 opposing walls of the pouch. It has a bottom wall 220 that sits inside the bottom wall 30 of the flexible shell. The side channel support 190 is a semi rigid, semi flexible molded component that flexes, expands, and contracts around items that are inserted and carried in the pouch. Additionally, as shown in FIGS. 1-5, the side channel support 190 is arranged between the back wall 60 and the front wall 50 and provides 220 for the binding cord 120 to travel though. As shown in FIGS. 18-21, these slots 220 serve to guide and protect the cord 120. Tension from the cord 120 provides pressure forcing the sides against the left and right side of the item being carried. Likewise, the sides can flex open to receive items of varying sizes and shapes.

Another feature of side channel support 190 combined with the flexible shell is that a flare or angle shape is created at the top of the opposing sides 200 and 210 that opens the mouth of the pouch. This flaring allows items to be easily inserted into the pouch. When combined with the flare of the front wall 50 and the flare of the back wall 60, this results in a flare on all sides of the pouch opening, such that insertion of items is smooth and snag free from any angle even though it is a soft pouch with compression qualities, which is a significant improvement over the soft pouches with compression qualities known in the prior art.

Additionally, as shown in FIG. 8, a bottom waved contour 230 is incorporated and molded into the bottom of the side channel support 190 and a pair of side waved contours 240 are incorporated and molded into the lower sides of the side channel support 190, which allows expansion and contraction of the sides of the side channel support 190. As shown in FIGS. 18-21, the side channel support has slots 220 along the length of the sides to allow for the flexible binding cord to be laced through the side channel supports 190.

The side channel supports 190 of the present invention can be used with various types of pouches, including hard shelled pouches, to allow expansion and contraction of the sides of the pouch, thereby conforming to a wider variety of sized items and improving the compression capabilities of the pouch.

As shown in FIGS. 18-21, the binding cord 120 is round or flat with a stretch, or elastic quality that expands and contracts as it is used to lace, weave, or bind the front wall 50, side channel support 190, and back wall 60 together capturing the flexible shell front and back walls 10 and 20. When all parts are combined, the binding cord 120 constricts the entire assembly together yet allows enough flexibility between components so that items of various shapes and sizes can be inserted into the pouch.

The binding cord 120 can be loosened or tightened giving a range of adjustment. Adjustment varies depending upon the size, shape, and the preferred tension and level of retention or security desired. Tightening the cord increases the pressure applied by the pouch to the item carried.

As shown in FIGS. 9-16, various configurations of the front plate and back plate are contemplated. Although in a different configuration than that shown in FIGS. 1-8, front wall 50 of the exoskeleton has a plurality of tabs 130 along the perimeter that sweep slightly upward at an angle away from the flexible shell and a plurality of recessed channels 140 connecting a plurality of apertures 150 in the tabs 130. The molded back wall 60 has a plurality of channels 110 that facilitates the attachment of the flexible, binding cord 120 that secures front, back, and side components with and elastic effect that provides variable compression against any item carried within the pouch.

As shown in FIGS. 18-21, when bound by the binding cord 120 that is woven from the back wall 50 through the side channel support slots 220 and in and out through the front wall tabs 130, pressure is created via the resulting torsion effect against any item carried within the pouch, such as a magazine 300, for example. Increasing the tension of the binding cord increases the torsion and the specific pressure. The binding cord 120 is generally constructed from an elastic material such as Cordura™ for front and back tension cord lacing.

Channels 110 or specific openings that are formed into the back wall 50, recessed channels 140 of the front wall tabs 130 and slots 220 in the side channel supports 190 of the pouch provide for protection of the binding cord 120, attachment points for the binding cord 120 and as a guided path for the weave and placement of the binding cord 120 and embody significant improvements over any other previously known pouch in the prior art. For example, the channels 110 of the back wall 50, shown in FIGS. 7 and 16 help weave the binding cord 120 between through the front wall apertures, side channel support slots 220 and the back wall apertures.

The inner friction surface of the flexible pouch combined with the front wall 50 is actuated by the applied tension of the binding cord 120 wherein a torsion effect is developed between the tabs 130 and the mounting surface of the front wall 50. This results with increased pressure that is transferred to specific locations along the front wall 50 and through the outer flexible shell to the surface against and directly onto the item being carried. This greatly enhances the retentive qualities and security of the pouch.

Figure 15:
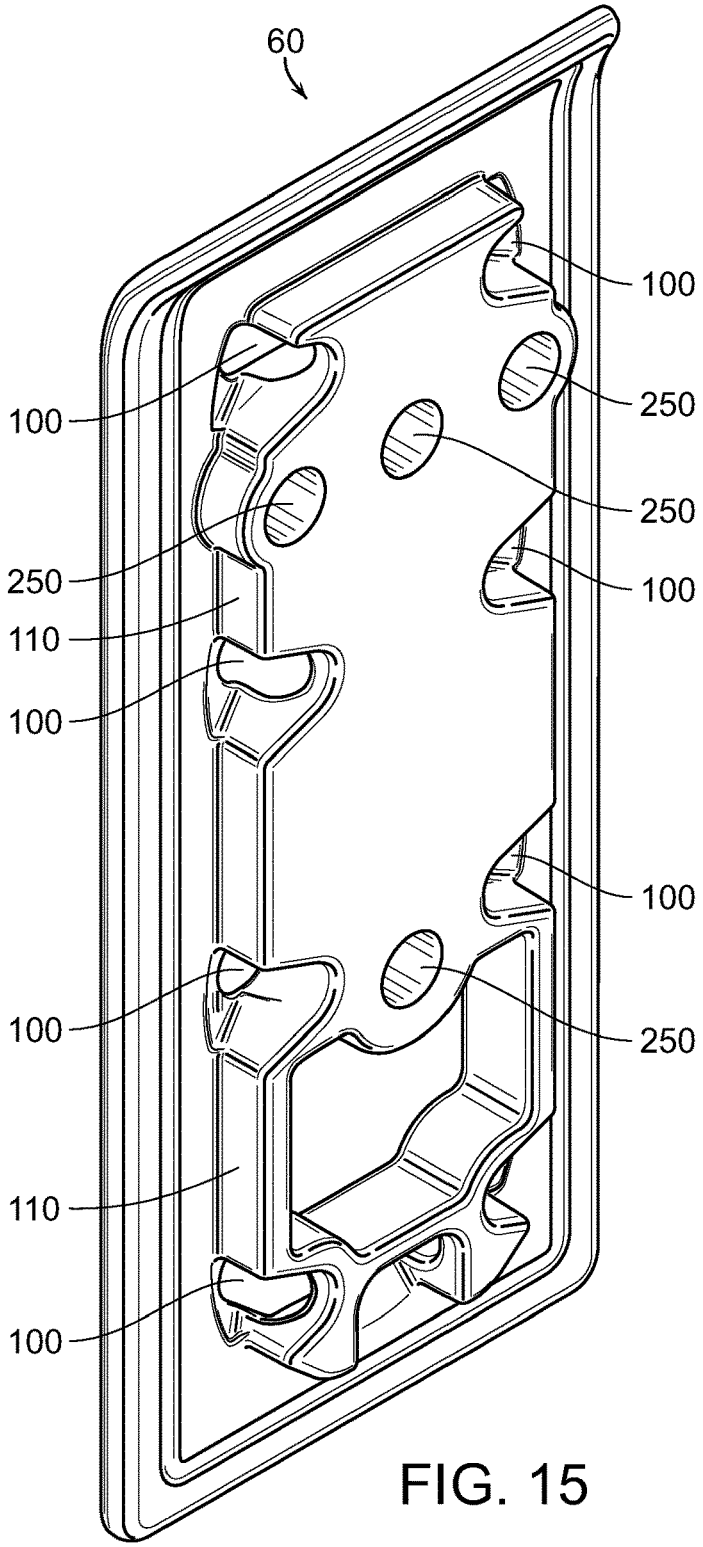
FIG. 15 perspective front view of back plate of the variable compression pouch of FIG. 9.
Figure 16:
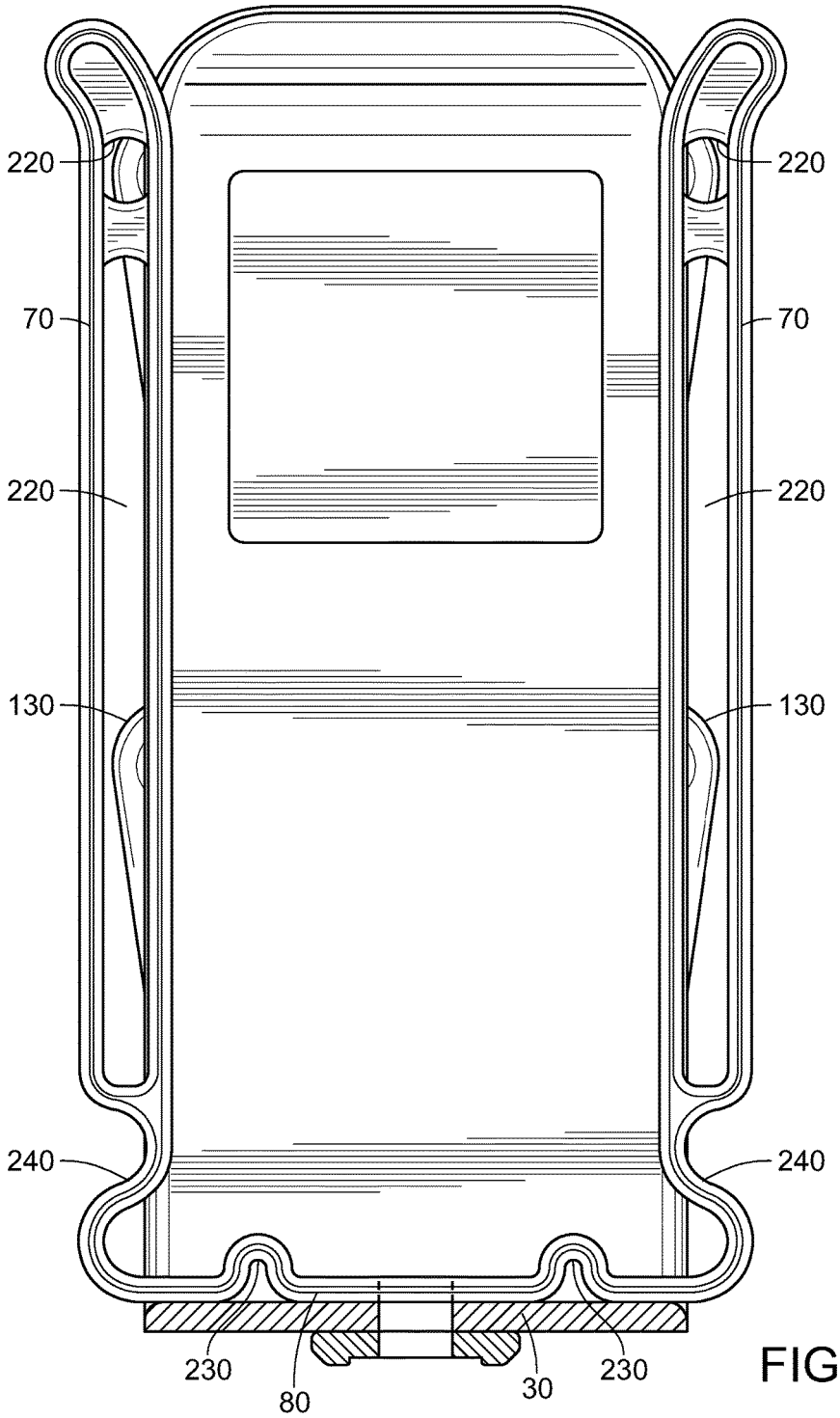
FIG. 16 front view of U-shaped portion of the variable compression pouch of FIG. 9.
Figure 17:
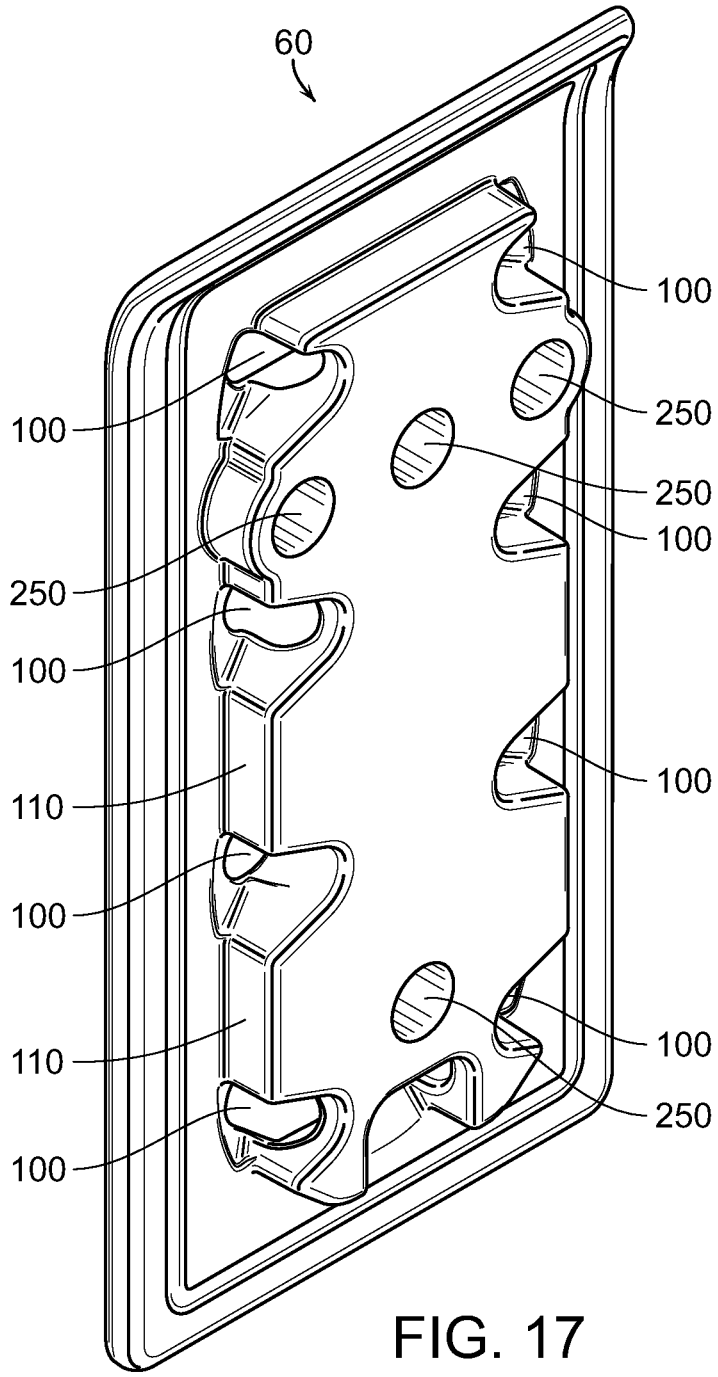
FIG. 17 perspective front view of back plate of an alternative embodiment of the variable compression pouch of the present invention.

The present invention is completely modular with an entire family of mounting components. For example, as shown in FIGS. 7, 15 and 18, there may threaded inserts 250 in the back wall 60 to allow for mounting of accessories. These accessories include but are not limited to, clips, belt loops, paddles, MOLLE attachment devises and many other accessories designed to expand and facilitate the carry of the pouch on, but not limited to, a belt, clothing, a vest, a harness, a leg panel, a pack, a vehicle, furniture or any and all other items wherein or whereon a user may desire to attach the pouch for use.

The flexible shell can be of various sizes yet still fit within the exoskeleton created by the front wall 50, back wall 60 and side walls 70. It is contemplated that the molded outer components are constructed from a thermoplastic elastomer material the material of flexible shell is construction from nylon fabric, leather, molded polymer or combinations thereof. However, the invention need not be limited to these materials.

The pair of opposing side walls 70 can be flared at the ends of the pouch top opening, which ensures a receptive path for items to be easily and smoothly inserted into the pouch. While some pouches known in the prior art have a flare on the left and right side, they leave the front and back surfaces to interfere with inserting items into the pouch. The present invention provides smooth and snag free insertion of items into the pouch from any angle even though it is a soft pouch with compression qualities.

The pouch construction maintains a positive, adjustable grip on its contents without additional securing systems. However, if additional retention is desired, tabs can be attached to the top edges of the flexible shell for use of "over the top" bungee retainers. In addition, a strip of hook, loop or hook and loop fastener, such as Velcro®, is attached to the back wall 60 of the exoskeleton for the user that utilizes adhesive hook and/or loop on their magazine belts.

In other embodiments, the present invention is an expandable, variable compression pouch for carrying items that need not contemplate an exoskeleton structure per se. For example, the general flaring of a front wall 50, back wall 60, bottom wall 80 and side walls 70, whether used in conjunction with a flexible shell or not, creates a flare or angle shape at the top end of the front 50, back 60 and side 70 walls. This creates a flare shape at the open end of the pouch. This flare allows items to be easily inserted into the pouch.

Similarly, in another embodiment, the present invention is an expandable, variable compression pouch for carrying items that need not contemplate an exoskeleton structure per se. A pair of opposing front 50 and back 60 walls, whether used in conjunction with a flexible shell or not, may be used in conjunction with a U-shaped support with a pair of opposing side walls 70 with a waved contour 230 incorporated and molded into the lower portion of the opposing sides 70 and a bottom wall 80 with a waved contour 240 incorporated and molded into the bottom wall 80, which allows expansion and contraction of the sides of the U-shaped support.

Soft and flexible pouches of the prior art do not allow for mounting of accessories or modularity with other accessories. However, the exoskeleton structure of the present invention allows for mounting bars or attachments points as a part of the outer molded components while maintaining the flexible pouch structure in order to accommodate various shaped and sized accessories.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the method (and components of the individual operating components of the method) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections might be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. An expandable, variable compression pouch for carrying items comprising:

a. a flexible shell with opposing front and back walls, a bottom wall, an open top end, an interior surface and an exterior surface;

b. a plurality of semi-flexible outer components forming an exoskeleton with opposing front and back walls, opposing side walls, a bottom wall and an open top end with a plurality of apertures along the perimeter of the front and back walls;

c. at least one channel on the outer surface of the molded outer components; and d. a binding cord;

wherein the opposing front and back walls, pair of opposing side walls, bottom wall and open top end defines an interior compartment;

wherein the exoskeleton supports the flexible shell; and wherein the binding cord is laced through the apertures of the molded outer components and at least one channel and tightened to compress the front and back walls against the flexible shell.

2. The expandable, variable compression pouch of claim 1 wherein the top ends of the molded outer components are flared away from the open top end.

3. The expandable, variable compression pouch of claim 1 wherein the front wall of the molded outer component further comprises (a) a plurality of tabs along the perimeter that sweep slightly upward at an angle away from the flexible shell; and (b) plurality of channels connecting a plurality of apertures in the tabs wherein the binding cord is laced through the apertures of the front wall tabs;

wherein the binding cord is further laced through the apertures along the perimeter of the back wall; and wherein the binding cord is tightened to compress the front and back walls towards the interior compartment.

4. The expandable, variable compression pouch of claim 1 wherein the opposing side walls and bottom wall are formed using a U-shaped support comprising (a) a pair of opposing sides, (b) a bottom wall, (c) a waved contour that is either incorporated and molded into the bottom wall, or incorporated and molded into the lower portion of at least one of the side walls; and (d) slots extending through the opposing sides.

5. The expandable, variable compression pouch of claim 4 wherein the binding cord is laced through the apertures of the front wall, apertures along the perimeter of the back wall, and the slots extending through the opposing sides and tightened to compress the front, back, and side walls.

6. The expandable, variable compression pouch of claim 1 further comprising at least one mounting bar attached to or molded into the front wall.

7. The expandable, variable compression pouch of claim 1 further comprising mounting positions along the back wall.

8. The expandable, variable compression pouch of claim 1 further comprising threaded inserts in the back wall.

9. The expandable, variable compression pouch of claim 1 further comprising tabs attached to the top open end of the flexible shell and a plurality of elastic cords, wherein the elastic cords are threaded through the tabs across the top end of the flexible shell to further compress the front and back walls.

10. The expandable, variable compression pouch of claim 1 further comprising a strip of hook, loop or both hook and loop fastener attached to an exterior surface of the back wall.

11. The expandable, variable compression pouch of claim 1 wherein the material of flexible shell is selected from the group comprising nylon fabric, leather, molded polymer or combinations thereof.

12. The expandable, variable compression pouch of claim 1 wherein the interior surface of the flexible shell is comprised of or lined with friction producing material.

13. The expandable, variable compression pouch of claim 12 wherein the friction producing material is high density polyethylene.

14. The expandable, variable compression pouch of claim 1 wherein the molded outer components are constructed from a thermoplastic elastomer material.

15. An expandable, variable compression pouch for carrying items comprising:

(a) front and back walls with a plurality of apertures along the front and back walls;

(b) a pair of opposing side walls;

(c) a bottom wall;

(d) an open top end; and (e) a binding cord;

wherein the opposing front and back walls, pair of opposing side walls, bottom wall and open top end defines an interior compartment;

wherein the binding cord is laced through the apertures of the front and back wall and tightened to compress the front and back walls;

wherein the top ends of the front wall, back wall and side walls are flared outward from the interior compartment at the open top end.

16. An expandable, variable compression pouch for carrying items comprising:

a. flexible shell with opposing front and back walls, a bottom wall, an open top end, an interior surface and an exterior surface defining an interior compartment;

b. a plurality of semi-flexible outer components forming an exoskeleton with opposing front and back walls, opposing side walls, a bottom wall and an open top end; and c. a flexible binding cord;

wherein the front wall has a plurality of tabs along the perimeter that sweep slightly upward at an angle away from the flexible shell and a plurality of recessed channels connecting a plurality of apertures in the tabs;

wherein the back wall has a plurality of apertures along the perimeter;

wherein the opposing front and back walls, pair of opposing side walls, bottom wall and open top end defines an interior compartment;

wherein the binding cord is laced through the apertures of the front wall tabs to rest inside the recessed channels;

wherein the binding cord is further laced through the apertures along the perimeter of the back wall; and wherein the binding cord is tightened to compress the front and back walls towards the interior compartment.

17. An expandable, variable compression pouch for carrying items comprising:

a. opposing front and back walls with a plurality of apertures along the front and back walls;

b. a U-shaped support comprising (a) a pair of opposing side walls, (b) a bottom wall, (c) a waved contour that is either incorporated and molded into the lower portion of at least one of the opposing side walls or incorporated and molded into the bottom wall; and (d) slots extending through the opposing sides walls;

c. an open top end; and d. a binding cord;

wherein the opposing front and back walls, pair of opposing side walls, bottom wall and open top end defines an interior compartment; and wherein the binding cord is laced through the apertures of the front and back wall, and the slots extending through the opposing side walls of the U-Shaped support and tightened to compress the front, back, and side walls.

18. An expandable, variable compression pouch for carrying items comprising:

a. a flexible shell with opposing front and back walls, a bottom wall, an open top end, an interior surface and an exterior surface;

b. a plurality of semi-flexible outer components forming an exoskeleton with opposing front and back walls, opposing side walls, a bottom wall and an open top end with a plurality of apertures along the perimeter of the front and back walls;

c. at least one mounting bar attached to or molded into the front wall; and d. a binding cord wherein the opposing front and back walls, pair of opposing side walls, bottom wall and open top end defines an interior compartment;

wherein the exoskeleton supports the flexible shell;

wherein the binding cord is further laced through the apertures along the perimeter of the front and back wall; and wherein the binding cord is tightened to compress the front and back walls towards the interior compartment.

19. An expandable, variable compression pouch for carrying items comprising:

a. a flexible shell with opposing front and back walls, a bottom wall, an open top end, an interior surface and an exterior surface;

b. a plurality of semi-flexible outer components forming an exoskeleton with opposing front and back walls, opposing side walls, a bottom wall and an open top end with a plurality of apertures along the perimeter of the front and back walls;

c. at least one mounting bar attached to or molded into the back wall; and d. a binding cord wherein the opposing front and back walls, pair of opposing side walls, bottom wall and open top end defines an interior compartment;

wherein the exoskeleton supports the flexible shell;

wherein the binding cord is further laced through the apertures along the perimeter of the front and back wall; and wherein the binding cord is tightened to compress the front and back walls towards the interior compartment.

* * * * *